US007100573B2

(12) United States Patent
Udd et al.

(10) Patent No.: US 7,100,573 B2
(45) Date of Patent: Sep. 5, 2006

(54) FUEL INJECTION SYSTEM

(75) Inventors: Sören Udd, Nödinge (SE); Sergi Yudanov, Västra Frölunda (SE)

(73) Assignee: Volvo Lastvagnar AB, Göteborg (SE)

( * ) Notice: Subject to any disclaimer, the term of this patent is extended or adjusted under 35 U.S.C. 154(b) by 300 days.

(21) Appl. No.: 10/708,656

(22) Filed: Mar. 17, 2004

(65) Prior Publication Data

US 2004/0255908 A1 Dec. 23, 2004

Related U.S. Application Data

(63) Continuation of application No. PCT/SE03/00506, filed on Mar. 27, 2003.

(60) Provisional application No. 60/319,539, filed on Sep. 9, 2002.

(51) Int. Cl.
*F02M 55/02* (2006.01)

(52) U.S. Cl. ..... 123/446; 123/447

(58) Field of Classification Search ..... 123/446, 123/447, 458, 506

See application file for complete search history.

(56) References Cited

U.S. PATENT DOCUMENTS 5,622,152 A 4/1997 Ishida
5,732,679 A 3/1998 Takahasi et al.
6,748,923 B1 * 6/2004 Zander et al. ..... 123/446
2004/0079335 A1 * 4/2004 Rodriguez-Amaya et al. ..... 123/446

FOREIGN PATENT DOCUMENTS

EP 0459429 A1 12/1991
FR 2797661 A1 2/2001

* cited by examiner

*Primary Examiner*—Thomas Moulis
(74) *Attorney, Agent, or Firm*—Novak Druce & Quigg, LLP

(57) ABSTRACT

The fuel injection system according to the invention comprises a nozzle (2) with an inlet and a needle (15). A control piston (16) forms a control chamber (17) and abuts the needle such that a higher pressure in the control chamber urges the piston to close the nozzle. A cam-driven plunger (5) forms a plunger chamber (7) connected to the inlet of the nozzle. The system also comprises a common rail (11) for fuel, a feed line (13) and an electrically operated valve (9). The valve isolates the chamber from the common rail and connects it to the line while in a third position, isolates it from both the line and the common rail in a second position, and isolates it from the line and connects it to the common rail in a first position. There are also means (12) for pressurizing the feed line with a relatively low fuel feed pressure and a fuel tank (20). The control chamber is connected to the common rail.

15 Claims, 9 Drawing Sheets

FUEL INJECTION SYSTEM

CROSS REFERENCE TO RELATED APPLICATIONS

The present application is a continuation patent application of International Application No. PCT/SE03/00506 filed 27 Mar. 2003 which was published in English pursuant to Article 21(2) of the Patent Cooperation Treaty. International Application No. PCT/SE03/00506 claims priority to Swedish Application No. 0201218-5 filed 23 Apr. 2002 and claims the benefit of U.S. Provisional Application No. 60/319,539 filed 9 Sep. 2002. Said applications are expressly incorporated herein by reference in their entireties.

BACKGROUND OF INVENTION

1. Technical Field

The present invention relates to an apparatus and method for injecting fuel into internal combustion engines, particularly compression ignition engines 2. Background Until the recent past, the known electronically controlled means of injecting fuel into modern diesel engines could be divided in two functionally different types: mechanically actuated systems and common rail systems. Both of these systems have their inherent advantages and disadvantages that dictate the choice of the system for a particular application. For instance, high pressure common rail systems rarely appear on today's heavy-duty diesel engines due to durability constraints related to the presence of very high fuel pressure in the rail and in the complex network of hydraulic lines for most of the engine operating time.

An integrated diesel fuel injection system has been proposed which combines the two separate types of systems as above into a single injection apparatus, allowing the engine management system to select the functional mode according to engine operating conditions. Such a system makes use of the mechanical actuation principle of the well-known unit injection systems to create high pressure for fuel injection, thereby avoiding durability limitations of the high pressure common rail systems, and can provide common rail-type injections in such conditions where lower injection pressure is beneficial and where extreme flexibility of injection timing is required. The common rail functional mode is secured in this known integrated fuel injection system through the use of a rail that is common for a set of injectors and that is fed with fuel under pressure by a separate pump. This arrangement works well but the total cost of the integrated fuel injection system would typically exceed that of an ordinary unit injection or common rail systems because of the presence of two fuel pressurization modules—unit injection plunger and the common rail pump.

SUMMARY OF INVENTION

The subject of the present invention is a low-cost integrated electronically controlled mechanical unit injection system with common rail functionality. The primary purpose of the invention is to reduce the overall system cost through utilization of the mechanical injection actuation means for both direct injection under high pressure and for creating and maintaining pressure in the common rail, thereby eliminating the need of a separate fuel pump for common rail pressure.

A primary object of the invention is to provide a low-cost integrated fuel injection system (FIE) allowing the mechanical injection actuation and the common rail principles to be used selectively at such conditions that permit utilization of their respective advantages, and to be selectively de-activated at other conditions to avoid their respective disadvantages. The cost reduction as compared to the known integrated FIE is achieved by designing the system in such a way that allows the engine management system to control the mechanical actuation means of the unit injection part of the system to both directly inject fuel into the engine under high pressure and to pressurize the common rail part of the system. This eliminates the need in a separate common rail pump thereby bringing a cost advantage and simplifying the overall system design.

Another object of the present invention is to provide a fuel injection system with a further reduced cost and an improved cylinder-to-cylinder, shot-to-shot uniformity and long-term stability of control of the nozzle opening pressure.

Still another object of the present invention is to provide a fuel injection system with an built-in, limp-home function that also allows for incorporation of advanced on-board diagnostic features in the overall control system.

DETAILED DESCRIPTION

Figure 1:
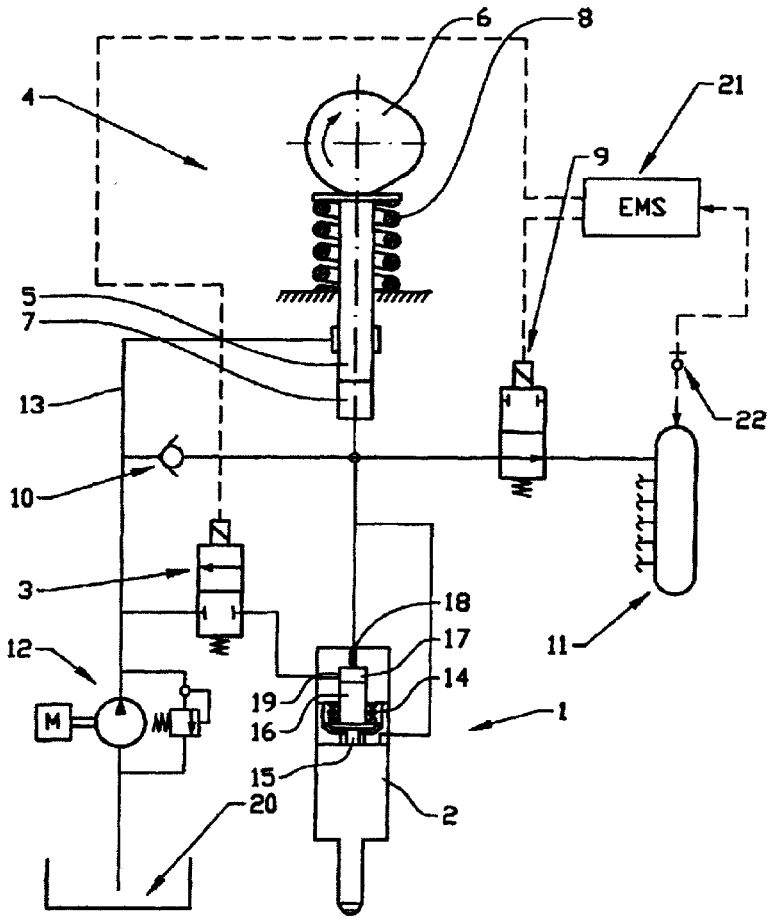
FIGS. 1 to 9 are diagrammatic views of various embodiments of the present invention.

In accordance with a first embodiment of the present invention shown in FIG. 1, a fuel injector 1 is provided that incorporates a conventional, normally closed nozzle 2 and an electrically operated nozzle control valve (NCV) 3. A mechanically actuated means 4 for pressurizing fuel is provided that comprises (includes, but is not limited to) a cam-driven plunger 5 with a cam 6 and a plunger chamber 7, a return spring 8 and an electrically operated valve 9. There is a non-return valve 10; a common rail 11 typically serving a set of said fuel injectors and mechanically actuated means in an engine (not shown); and a means 12 for maintaining a relatively low feed pressure of the fuel in a feed line 13 and a fuel tank 20. The electrically operated valve 9 is installed between the plunger chamber 7 and the common rail 11. The inlet of the non-return valve 10 is connected to the feed line 13, and the outlet of the non-return valve is connected to the plunger chamber 7. An engine management system 21 controls valves 3 and 9 and receives feedback from the engine and the fuel system, specifically, common rail pressure feedback from a sensor 22.

The fuel injector 1 is designed to operate as a high pressure common rail injector of known design. As is typical to such known injectors, injector 1 contains a spring 14 biasing a needle 15 to close the nozzle 2; a control piston 16 with a control chamber 17 arranged such that higher pressure in the control chamber tends to urge the control piston to push onto the needle 15 to close the nozzle; an input throttle 18 and an outlet port 19. The input throttle 18 connects the control chamber 17 with the plunger chamber 7 and the outlet port 19 connects the control chamber with the NCV 3. The NCV can, upon receiving a command, open and connect the outlet port 19 to the return line 13. The flow areas of the input throttle, outlet port and the NCV are chosen such that an opening of the NCV can cause a pressure drop in the control chamber that is sufficient to allow the pressure acting on a differential area of the needle 15 to open the nozzle 2. Also typical to the known high pressure common rail injectors, the outlet port 19 and the control piston 16 are designed such that the control piston is able to restrict the outlet port at a position corresponding to an open nozzle, thereby limiting the leakage of pressurized fuel through the input throttle 18, output port 19 and open control valve 3 to the return line 13.

The plunger chamber 7 is connected to the inlet of the nozzle 2. The plunger chamber can be connected to, or disconnected from the common rail 11, depending on the state of the valve 9. The common rail 11 is equipped with a means (either automatic or manually operated) for removing air from the volumes of the system (not shown).

The fuel injection system works as follows: at engine start-up, the means 12 typically consisting of a low pressure gear pump and a pressure regulator, pressurize the entire system, including the common rail 11 and the plunger chamber 7, with fuel under relatively low feed pressure. Fuel under feed pressure is supplied to the system via the non-return valve 10 and the open valve 9. During an initial part of the pumping stroke of the plunger 5, valve 9 remains open until the instant when pressure build-up should begin for an injection. During this initial part of the pumping stroke, fuel is displaced from the plunger chamber 7 to the common rail 11 and the pressure in the common rail increases. When fuel pressure should be built up to inject fuel, the valve 9 closes and plunger 5 pressurizes the chamber 7 and the control chamber 17 because the non-return valve 10 is by then closed. To begin injection, the NCV 3 opens connecting the control chamber 17 to the feed line 13 via the output port 19, the pressure in the control chamber 17 falls allowing the control piston 16 and the needle 15 to lift up and open the nozzle. Then, fuel is injected through the open nozzle under the pressure created by the plunger 5. To end the injection, the valve 9 opens and the NCV closes. Following the closure of the NCV, the pressures in the control chamber 17 and the nozzle 2 equalize so that spring 14 is able to close the nozzle. During the remaining part of the pumping stroke of the plunger 5, the pressurized fuel escapes from the plunger chamber 7 via the open valve 9 to the common rail 11. This type of system operation resembles the functional principle of the unit injector and unit pump systems well known in the prior art and will be further referred to as EUI mode of operation.

To enable the system to further increase fuel pressure in the common rail in the next engine cycles, the valve 9 is closed for a period of time during the retraction of the plunger. This prevents the rail pressure from falling due to the volume increase by the retracting plunger 5. When the valve 9 closes, the plunger reduces the pressure in the plunger chamber 7 down to the level somewhat below the feed pressure, which opens the non-return valve 10 and fills up the plunger chamber with the fuel from the feed line 13. By means of adjusting the duration of closing of the valve 9 on the filling stroke of the plunger, the amount of extra fuel supplied from the feed line to the plunger chamber 7 and further displaced to the common rail 11, can be controlled. Increasing the amount of extra fuel will raise the pressure in the common rail and vice versa. A precise control of engine cycle-average pressure in the common rail 11 can be easily achieved with an EMS 21 utilizing pressure feedback information from a sensor 22 (See FIG. 1).

Once a pressure level in the common rail that exceeds the spring nozzle opening pressure has been reached, the system can operate in a common rail (CR) mode. The CR operational mode will typically be used when high injection pressure is not required for the injection, for example, with the engine at idle or relatively low load point, as well as for pilot injections and low-pressure late post injections. In this mode, the valve 9 remains open throughout the entire pumping stroke of the plunger 5. During the pumping stroke, the fuel is displaced through the valve 9 back to the common rail such that there is very little pressure build-up in the plunger chamber 7. To start an injection, the NCV 3 opens, the pressure in the control chamber 17 falls allowing the control piston 16 and the needle 15, driven by the pressure in the nozzle, to lift up and open the nozzle. Then, fuel is injected under the common rail pressure through the open nozzle, until the NCV is closed again. Following the closure of the NCV, the pressure in the control chamber 17 rises back to the level of the common rail pressure and the control piston 16, assisted by the spring 14, closes the nozzle. It will be understood that for the CR operational mode to work, the difference between the pressures in the common rail 11 and the return line 13 should be bigger than the spring opening pressure of the nozzle 2, said spring opening pressure being defined by the pre-load of the spring 14 and the size of the differential area of the closed needle 15 as is well known in the art.

The common rail pressure control with the system in the CR mode will be performed in the same way as described above, i.e. by pulsing the valve 9 closed during the filling strokes of the plunger 5.

The CR operational mode allows to reduce the mechanical noise of the injection system by eliminating the wind-up and rapid release of the wound-up transmission driving the mechanical actuation means, that is characteristic to the mechanically actuated FIE and, particularly, unit injectors. The availability of the common rail pressure also allows for fuel injection at any point of the engine cycle. Maximum design limit on the working pressure in the common rail will be a compromise between the cost, reliability and other parameters limiting maximum pressure on one hand and, on the other hand, the benefits such as injection timing flexibility, noise reductions and other that improve engine characteristics.

When a higher injection pressure is required during normal engine operation, the fuel injection system according to the present invention will be used in the EUI mode. By means of utilizing the EUI mode of operation, very high injection pressures that are characteristic to the known unit injector and unit pump systems, can be achieved. Nevertheless, the present invention is free from the drawbacks of the high pressure common rail systems associated with having very high pressure in the common rail and other volumes, because the high pressure generated for direct injection into the engine is kept to relatively small volumes by the closed valve 9. In fact, the common rail pressure during the EUI operational mode can be reduced down to the feed pressure level by disabling the CR pressure control function of valve 9, such that it is always open between the EUI injection events.

Figure 2:
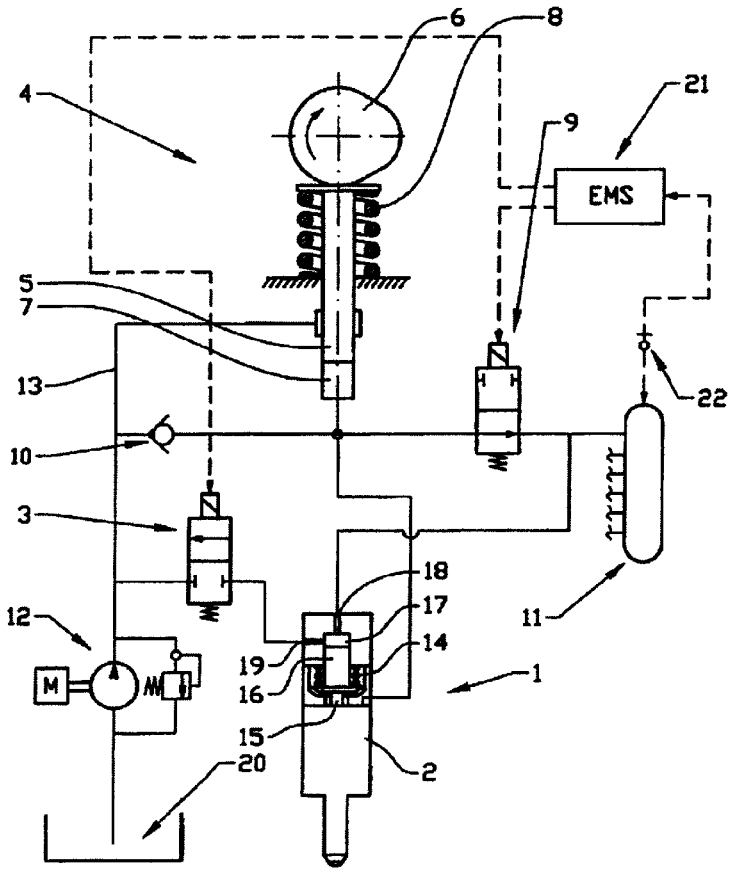

In order to provide for improved safety of operation in the EUI mode, the input throttle 18 can be connected to the common rail 11 as shown in FIG. 2. This embodiment of the present invention allows to avoid injector overpressure in case of the failure of the NCV to open during the pumping stroke of the plunger. The nozzle opening pressure in this case will be limited by the pressure in the common rail 11, pre-load of the return spring 14 and the diameter of the control piston 16.

The embodiment shown in FIG. 2 enables on-board diagnosis of the condition of the NCV valve. To check whether it operates at all, an OBD system can compare the engine speeds at some specific diagnostic running condition with the NCV valve control function activated and de-activated by the EMS 21. If the NCV operates, it can start an injection at a lower NOP than the limit defined by the common rail pressure, which is known to the OBD system at any time. A change in NOP will affect the amount of fuel delivered by the particular injector, which can be detected by the OBD through engine speed measurement. Thus it can be determined if the NCV of a particular injector does not operate. The diagnostic system could be further refined to allow for calibration check of the NCV, if the threshold of CR pressure beyond which the NCV activation does not make a difference on amount of injected fuel can be determined with sufficient accuracy. Once this threshold is known, the actual NOP can be calculated, and then a target NOP for the injector can be looked up in the table of factory settings against the relative activation timings of valve 9 and NCV at which the threshold was detected. A good match will indicate that the factory calibration of the NCV is still valid, and vice versa.

Additionally, the embodiment of FIG. 2 provides a limp-home function for the engine in case of failure of the NCV valve(s). This is because it can still operate with the NCV stuck in the closed position without excessive pressure build-up in the injector that can lead to mechanical breakdown of the engine. Such possible overpressure is an issue in some existing versions of the unit injection systems with NCV-controlled NOP.

The other aspect in which the embodiment of FIG. 2 can be advantageous is that it allows a set of injectors of a multi-cylinder engine to operate at a common nozzle opening pressure by disabling the nozzle control valves 3 altogether in the EUI mode. Common rail pressure control will provide variable NOP capability for the system, with the benefit of real-time accurate monitoring of the NOP for each injector by the EMS based on the feedback information from the sensor 22. The NOP control will therefore no longer be individual for each injector but common for the set of injectors bringing the advantage of better sample-to-sample, shot-to-shot and long-term stability of this parameter. The quality of the end of injection can be maintained by the use of the control piston 16 of an increased diameter.

Figure 3:
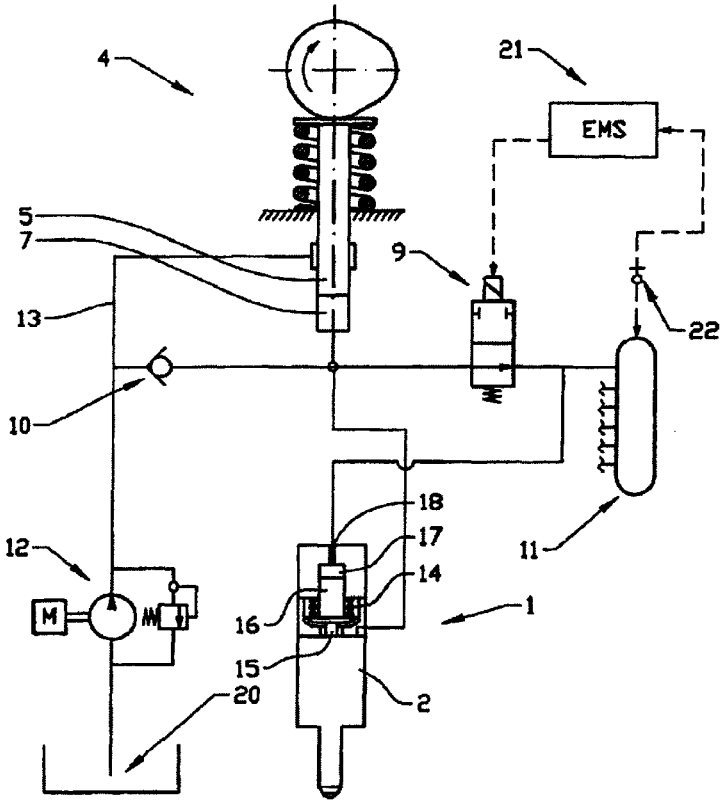

In some cost-critical applications it can be beneficial to utilize the present invention in another embodiment shown in FIG. 3, in which there is only one electrically operated control valve (9) per injector. Such a system will operate in the EUI mode only, but it will have variable NOP which can be set at a desired level by appropriate control of the common rail pressure through adjusting the durations of closing of the control valve during filling strokes of the plunger 5, according to the above described principle. It can also be mentioned for the sake of completeness that a separate pumping unit can be used to create and control common rail pressure in the embodiment as per FIG. 3, if that is found beneficial.

Figure 4:
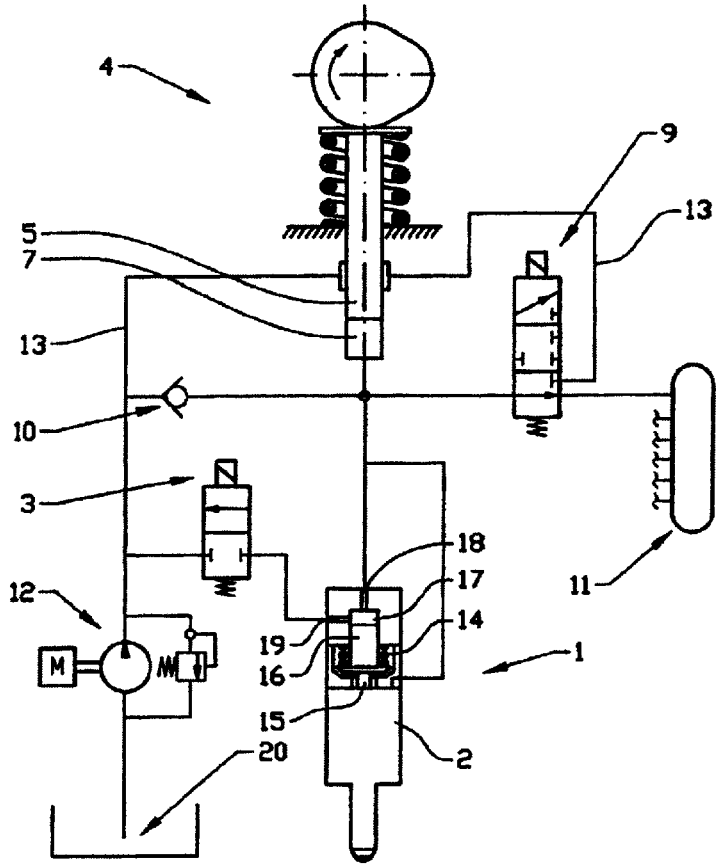

Another embodiment of the present invention shown in FIG. 4 incorporates a three position/three-way valve 9 between the plunger chamber 7 and the common rail 11. The valve 9 can alternatively connect the plunger chamber 7 to the common rail or to the return line 13, or isolate the chamber from both of them. The rest of the design is identical to that shown in FIG. 1. One advantage of configuring the present invention according to the embodiment of FIG. 4 is that a so-called "spill end" of injection can be used where necessary.

The CR mode of operation is achieved by opening the NCV 3 and thereby releasing the pressure from the control chamber 17, which in turn allows the nozzle 2 to open. During a CR-mode injection, fuel is supplied to the nozzle from the common rail through the open control valve 9 as shown in FIG. 4. This position of the valve 9 will be referred to as a first position. Closing the NCV raises the pressure in the control chamber 17 and eventually closes the nozzle. Any fuel displaced by the plunger 5 during the pumping stroke passes back to the common rail through the valve 9, which prevents significant extra pressure from being generated in the system.

In the EUI mode of operation, the valve 9 is switched from the first to a second position during the pumping stroke of the plunger 5. In the second position, valve 9 isolates the plunger chamber 7 from both common rail 11 and return line 13. Pressure in the system then rises and, upon reaching a desired pressure level, the NCV is open allowing the needle 15 to open the nozzle as described above. Fuel injection occurs at a high pressure generated by the plunger. To end an injection, several options are available. Typically, the NCV will close, re-pressurizing the control chamber 17. If a pressure-backed end of injection is desired, the control valve 9 can be either left closed in the second position for a period of time corresponding to the closing duration of the nozzle, or switched back to the first position. The nozzle will then be closed at a high pressure in the control chamber 17, which will be assisting the return spring 14 in closing the nozzle quicker. If a spill end of injection is desired, the valve 9 will be switched to a third position connecting the plunger chamber 7 to the return line 13 and isolating it from the common rail. By this means, the nozzle will be closed with the return spring 14 while fuel pressure in the nozzle is low.

When utilizing spill end of injection, the duration of closing of the valve 9 during the filling strokes of the plunger has to be increased to offset the amount of fuel returned to the feed line 13 during spill.

Figure 5:
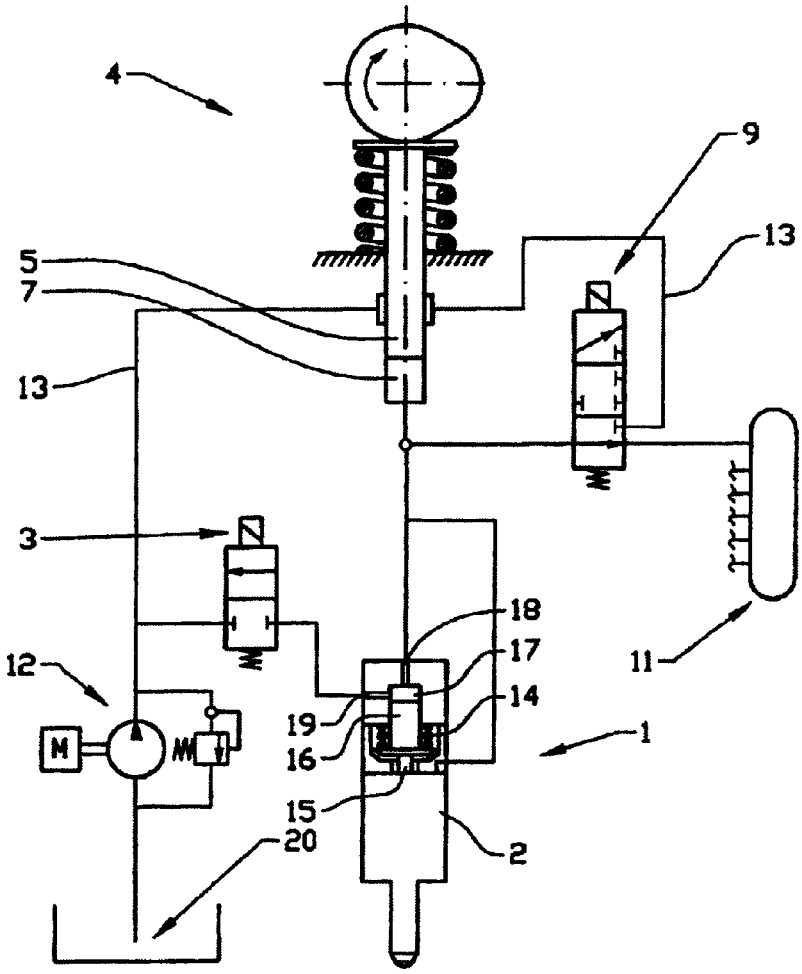

An alternative form of this embodiment shown in FIG. 5 makes use of the availability of the third position of the valve 9 to perform control of the common rail pressure so that there is no need to utilize a non-return valve between the feed line 13 and the plunger chamber 7 to allow for filling of the latter. To fill the plunger chamber from the feed line, the valve 9 is either kept in the third position for some time following a spill end of injection, or switched over to the third position for a time before returning it to the first position. This will replenish the volumes with fuel displaced into the engine's cylinder on the previous operation cycle.

Figure 6:
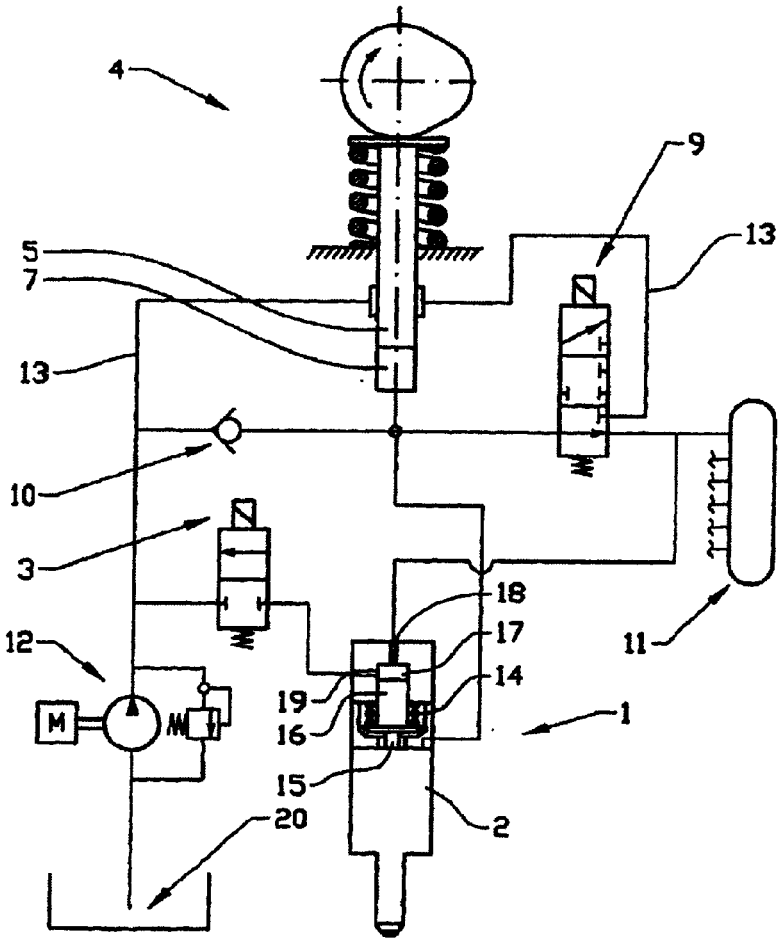

In case a simultaneous use of the spill end and the pressure-backed end of injection is an advantage, the input throttle 18 can be connected directly to the common rail as shown in FIG. 6. To end an injection, the NCV 3 is closed and the valve 9 is switched to the third position to release the pressure from the plunger chamber and the nozzle. Then, the needle 15 closes the nozzle under the combined action of the return spring 14 and the pressure difference between the control chamber 17 and the nozzle. In this embodiment of the present invention, a relatively weak return spring 14 of the nozzle can be used, which can allow for lower minimum common rail pressure setting that can be used for the CR mode of operation.

Figure 7:
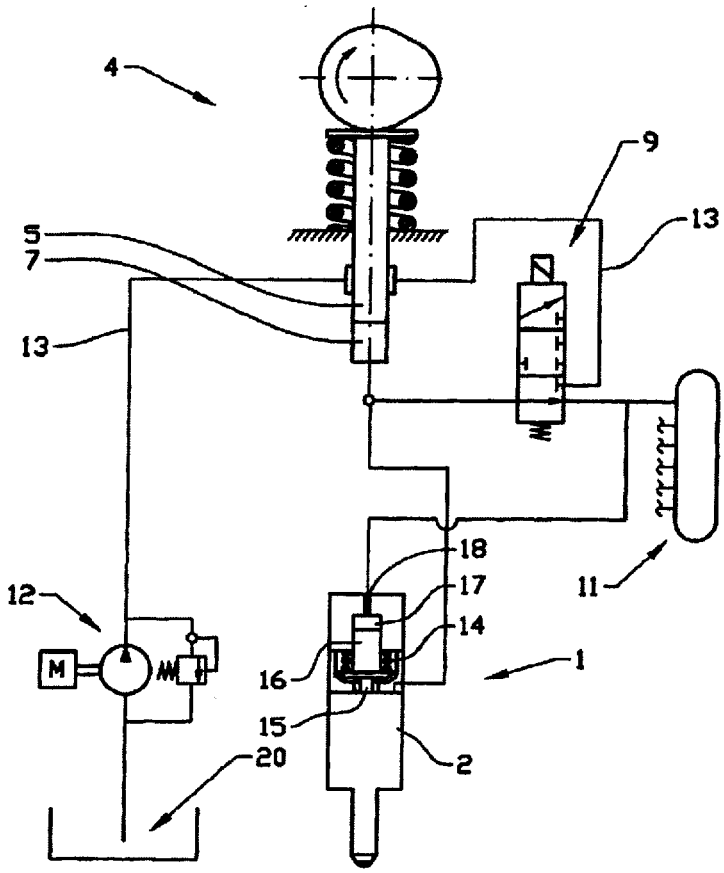

Similarly to the embodiment shown in FIG. 3, the invention can be configured to have a single three-position electrically operated control valve (9) per injector as shown in FIG. 7. The three-position valve 9 will give an advantage of a faster injection end due to the ability of the injection system to spill the pressure as described above.

Figure 8:
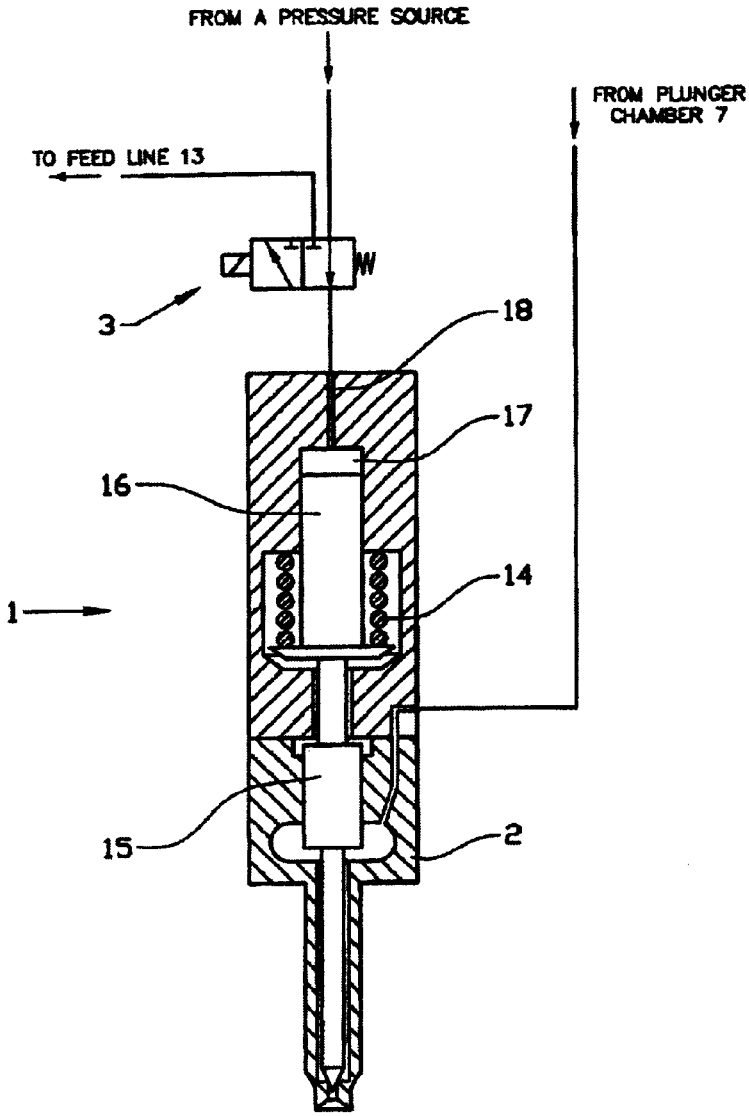

It will be appreciated by those skilled in the art that in any of the embodiments described above, the two-way NCV valve 3 can be replaced by a three-way NCV valve as illustrated by FIG. 8.

Figure 9:
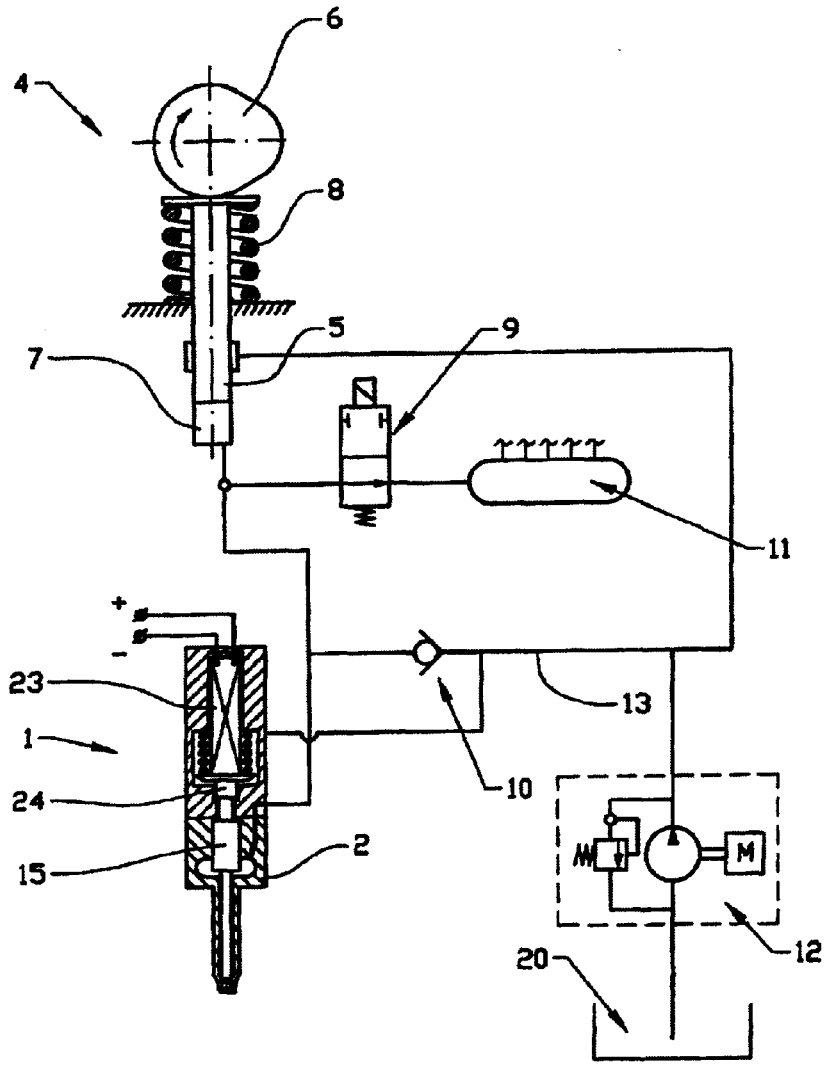

Yet another embodiment of the present invention shown in FIG. 9 incorporates an electrically actuated nozzle control valve 23 which directly controls the position of the needle 15 of the nozzle 2. The needle 15 can be mechanically connected to the moveable armature 24 of the NCV 23. The CR and/or the EUI operational modes, as well as their combinations, and the common rail pressure control are realized in this embodiment in the same way as previously described. The NCV can be solenoid-actuated or, preferably, piezo-actuated to achieve fast and precise control of the position of the needle 15.

While the present invention has been disclosed in connection with the preferred embodiments thereof, it should be understood that there might be other embodiments that fall within the spirit and scope of the invention as defined by the following claims.

What is claimed is:

1. A fuel injection system comprising a nozzle (2) with an inlet and a needle (15); a resilient means (14) biasing the needle (15) to close the nozzle (2); a control piston (16) forming a control chamber (17) and abutting the needle (15) such that a higher pressure in the control chamber (17) tends to urge the control piston (16) onto the needle (15) to close the nozzle (2); a cam-driven plunger (5) forming a plunger chamber (7), said plunger chamber connected to the inlet of the nozzle (2); a common rail (11) for fuel; a feed line (13); an electrically operated valve (9) being able to isolate said plunger chamber (7) from the common rail (11) and connect the plunger chamber (7) to the feed line (13) while in a third position, isolate the plunger chamber (7) from both the feed line (13) and the common rail (11) while in a second position, and isolate the plunger chamber (7) from the feed line (13) and connect the plunger chamber (7) to the common rail (11) while in a first position; a means (12) for pressurizing a feed line (13) with a relatively low fuel feed pressure; and a fuel tank (20), said fuel injection system characterized in that said control chamber (17) is connected to the common rail (11).

2. The fuel injection system as recited in claim 1, wherein a non-return valve (10) is installed between said feed line (13) and the plunger chamber (7), with the inlet of said non-return valve connected to the feed line (13).

3. The fuel injection system as recited in claim 1, further comprising an electrically operated nozzle control valve (NCV) (3), said NCV being able to isolate said control chamber (17) from said feed line (13) and open hydraulic communication between the control chamber (17) and said common rail (11) while in a first position and being able to isolate the control chamber (17) from the common rail (11) and hydraulically connect the control chamber (17) to the feed line (13) while in a second position.

4. A fuel injection system comprising a nozzle (2) with an inlet and a needle (15); a resilient means (14) biasing the needle (15) to close the nozzle (2); a control piston (16) forming a control chamber (17) and abutting the needle (15) such that an [sic] higher pressure in the control chamber (17) tends to urge the control piston (16) onto the needle (15) to close the nozzle (2); a cam-driven plunger (5) forming a plunger chamber (7), said plunger chamber connected to the inlet of the nozzle (2); a common rail (11) for fuel; a feed line (13); an electrically operated valve (9) being able to isolate said plunger chamber (7) from the common rail (11) and connect the plunger chamber (7) to the feed line (13) while in a third position, isolate the plunger chamber (7) from both the feed line (13) and the common rail (11) while in a second position, and isolate the plunger chamber (7) from the feed line (13) and connect the plunger chamber (7) to the common rail (11) while in a first position; an electrically operated nozzle control valve (NCV) (3), said NCV being able to isolate said control chamber (17) from said feed line (13) and open hydraulic communication between the control chamber (17) and said plunger chamber (7) while in a first position and being able to isolate the control chamber (17) from the plunger chamber (7) and hydraulically connect the control chamber (17) to the feed line (13) while in a second position; a means (12) for pressurizing a feed line (13) with a relatively low fuel feed pressure; and a fuel tank (20).

5. The fuel injection system as recited in claim 4, wherein a non-return valve (10) is installed between said feed line (13) and the plunger chamber (7), with the inlet of said non-return valve connected to the feed line (13).

6. A fuel injection system for an internal combustion engine comprising a nozzle (2) with an inlet; a cam-driven plunger (5) forming a plunger chamber (7), said plunger chamber connected to the inlet of the nozzle; a common rail (11) for fuel; a feed line (13); an electrically operated valve (9) being able to isolate said plunger chamber (7) from the common rail (11) and connect the plunger chamber (7) to the feed line (13) while in a third position, isolate the plunger chamber (7) from both the feed line (13) and the common rail (11) while in a second position, and isolate the plunger chamber (7) from the feed line (13) and connect the plunger chamber (7) to the common rail (11) while in a first position; an electrically actuated nozzle control valve (23) for opening and closing of the nozzle (2); a means (12) for pressurizing a feed line (13) with a relatively low fuel feed pressure; and a fuel tank (20).

7. The fuel injection system as recited in claim 6, wherein a non-return valve (10) is installed between the feed line (13) and the plunger chamber (7), with the inlet of said non-return valve being connected to the feed line (13).

8. A fuel injection system for an internal combustion engine comprising a nozzle (2) with an inlet; a cam-driven plunger (5) forming a plunger chamber (7), said plunger chamber connected to the inlet of the nozzle; a common rail (11) for fuel; an electrically operated valve (9) installed between the plunger chamber (7) and the common rail (11), said valve (9) being able to open or close hydraulic communication between the plunger chamber and the common rail upon receiving an electrical control command; an electrically actuated nozzle control valve (23) for opening and closing of the nozzle (2); a means (12) for pressurizing a feed line (13) with a relatively low fuel feed pressure; a fuel tank (20); a non-return valve (10), characterized in that the inlet of said non-return valve is connected to the feed line (13) and the outlet of the non-return valve is connected to the plunger chamber (7).

9. A fuel injection system comprising a nozzle (2) with an inlet and a needle (15); a resilient means (14) biasing the needle (15) to close the nozzle (2); a control piston (16) forming a control chamber (17) and abutting the needle (15) such that an [sic] higher pressure in the control chamber (17) tends to urge the control piston (16) onto the needle (15) to close the nozzle (2); a cam-driven plunger (5) forming a plunger chamber (7), said plunger chamber connected to the inlet of the nozzle (2); a common rail (11) for fuel; an electrically operated valve (9) installed between the plunger chamber (7) and the common rail (11), said valve (9) being able to open or close hydraulic communication between the plunger chamber (7) and the common rail (11) upon receiving an electrical control command; a means (12) for pressurizing a feed line (13) with a relatively low fuel feed pressure; a fuel tank (20); a non-return valve (10), wherein the inlet of said non-return valve is connected to said feed line (13) and the outlet of the non-return valve is connected to the plunger chamber (7); said fuel injection system characterized in that said control chamber (17) is connected to the common rail (11).

10. The fuel injection system as recited in claim 9, further comprising an electrically operated nozzle control valve (NCV) (3), said NCV being able to isolate said control chamber (17) from said feed line (13) and open hydraulic communication between the control chamber (17) and said common rail (11) while in a first position and being able to isolate the control chamber (17) from the common rail (11) and hydraulically connect the control chamber (17) to the feed line (13) while in a second position.

11. The fuel injection system as recited in claim 10, wherein said NCV isolates said control chamber (17) from said feed line (13) and opens hydraulic communication between the control chamber (17) and said plunger chamber (7) while in a first position and isolates the control chamber (17) from the plunger chamber (7) and hydraulically connects the control chamber (17) to the feed line (13) while in a second position.

12. The fuel injection system as recited in claim 1, wherein said control chamber (17) is provided with an input throttle (18) and an outlet port (19), further wherein said input throttle (18) is connected to said common rail (11) and the only function of said NCV (3) is to open or close hydraulic communication between said outlet port (19) and said feed line (13), said fuel injection system characterized in that the effective flow areas of said input throttle (18), outlet port (19) and the NCV (3) and the force of said resilient means (14) are chosen such that an opening of the NCV can cause said needle (15) to open said nozzle (2) when the pressure at the inlet of the nozzle is sufficiently high.

13. The fuel injection system as recited in claim 4, wherein said control chamber (17) is provided with an input throttle (18) and an outlet port (19), further wherein said input throttle (18) is connected to said plunger chamber (7) and the only function of said NCV (3) is to open or close hydraulic communication between said outlet port (19) and said feed line (13), said fuel injection system characterized in that the effective flow areas of said input throttle (18), outlet port (19) and the NCV (3) and the force of said resilient means (14) are chosen such that an opening of the NCV can cause said needle (15) to open said nozzle (2) when the pressure at the inlet of the nozzle is sufficiently high.

14. The fuel injection system as recited in claim 12, wherein said outlet port (19) and the control piston (16) are designed such that the control piston (16) is able to restrict the flow area of the outlet port (19) at a position corresponding to an open nozzle (2), thereby limiting the leakage of pressurized fuel through the input throttle (18), output port (19) and open NCV (3) to the feed line (13).

15. The fuel injection system as recited in claim 1, wherein a sensor (22) is provided to supply information about the pressure of the fuel in the common rail to an engine management system (21).

* * * * *